United States Patent [19]

Dittmann et al.

[11] Patent Number: 4,684,910

[45] Date of Patent: Aug. 4, 1987

[54] ARMATURE RETAINING SPRING AND COIL FLANGE CONTACT CHAMBER FOR AN ELECTROMAGNETIC RELAY

[75] Inventors: Michael Dittmann, Berlin; Heinz Stadler, Munich, both of Fed. Rep. of Germany

[73] Assignee: Siemens Aktiengesellschaft, Berlin and Munich, Fed. Rep. of Germany

[21] Appl. No.: 894,825

[22] Filed: Aug. 8, 1986

[30] Foreign Application Priority Data

Aug. 9, 1985 [DE] Fed. Rep. of Germany ..... 3528715
Dec. 5, 1985 [DE] Fed. Rep. of Germany ..... 3543092

[51] Int. Cl.[4] ..... H01F 7/13
[52] U.S. Cl. ..... 335/274; 335/278
[58] Field of Search ..... 335/128, 202, 274, 276, 335/278

[56] References Cited

U.S. PATENT DOCUMENTS

| | | | |
|---|---|---|---|
| 4,045,755 | 8/1977 | Schroeder et al. | 335/274 |
| 4,338,585 | 7/1982 | Volke | 335/274 |
| 4,507,633 | 3/1985 | Minks | 335/278 X |
| 4,532,487 | 7/1985 | Nagamoto et al. | 335/128 |

FOREIGN PATENT DOCUMENTS

| | | | |
|---|---|---|---|
| 2231525 | 12/1973 | Fed. Rep. of Germany | 335/128 |
| 3232679 | 3/1983 | Fed. Rep. of Germany | 335/128 |
| 8235283 | 4/1983 | Fed. Rep. of Germany | 335/128 |
| 3506354 | 2/1985 | Fed. Rep. of Germany | 335/128 |
| 1512569 | 2/1968 | France | 335/128 |
| 2094246 | 2/1972 | France | 335/128 |

*Primary Examiner*—George Harris
*Attorney, Agent, or Firm*—Hill, Van Santen, Steadman & Simpson

[57] ABSTRACT

An electromagnetic relay includes a coil having a winding between two coil flanges wherein one of the coil flanges forms a pocket-shaped contact chamber. An angled yoke is provided for the coil on which is seated a flat armature that is secured by an armature retaining spring. Male retaining members extending from the angled yoke mount the retaining spring and can be bent to set the armature restoring force. Separation of the moving parts of the relay at an end face of one coil flange from the winding enables casting compound to fill the winding space and seal the contact chamber.

11 Claims, 9 Drawing Figures

ARMATURE RETAINING SPRING AND COIL FLANGE CONTACT CHAMBER FOR AN ELECTROMAGNETIC RELAY

BACKGROUND OF THE INVENTION

1. Field of the Invention

The present invention relates to an electromagnetic relay having a coil mounted to an angular yoke having a first leg perpendicular to the coil axis and a second leg parallel to the coil axis with an armature and an armature retaining spring provided at the yoke second leg.

2. Description of the Prior Art

Electromagnetic relays are known having coil members serving as a base body and carrying windings between a pair of flanges with a pocket-shaped contact chamber being provided at the first flange. An angular yoke has a first leg perpendicular to the coil axis and is coupled to a core extending from the interior of the coil, the first leg forming a terminal spine at its free end. A second leg of the angular yoke extends parallel to the coil axis above the winding and has a plate-shaped armature seated at a bearing edge at the free end of the second yoke leg. The armature forms a working air gap at an end face of the coil core and at the first coil flange. An armature retaining spring has a first portion secured to the yoke and a second portion secured to the armature. A third portion of the armature retaining spring includes contacts and extends into the contact chamber. A protective cap covers the coil member and other relay parts.

The above-described relay is disclosed, for example, by German Utility Model No. 82 35 283. The disclosed relay includes an armature retaining spring disposed arcuately over an armature bearing, and having a first portion of the retaining spring lying flat against an upper surface of the second yoke leg. The armature retaining spring is, thus, fastened behind the bearing edge on the broad yoke leg, making subsequent adjustment of the spring and setting of the armature restoring force impossible. It is therefore not possible to set the relay for optimum operation. Moreover, since the disclosed relay has a current carrying yoke which serves as a feeder for the armature retaining spring, the dielectric strength between the yoke and the winding is inadequate for some applications.

As proposed in an earlier German Patent Application, No. P 35 06 354, in such cases an insulating cap is plugged into the wound coil member prior to the attachment of the yoke. This requires, however, that an additional part be manufactured and assembled in the insulating cap. Furthermore, it is difficult to seal such relay. In particular, it is not possible to achieve a tight closure of the coil winding from the contact chamber by the use of a casting compound, since the armature retaining spring lies against the second yoke leg and does not provide separation of the winding space from the movable relay parts.

SUMMARY OF THE PRESENT INVENTION

An object of the present invention is to provide a modified and improved relay which has a compact structure. Another object is to seal the coil space from the contact chamber and to increase the dielectric strength in the coil space when required and to simultaneously seal the contact chamber.

These and other objects are achieved in an electromagnetic relay of the present invention having a free end of the second yoke leg provided with a male retaining member projecting beyond a bearing edge and an armature retaining spring having a first portion in front of the bearing edge and mounted against the male retaining member. An armature which is held by the retaining spring preferably includes a recess in the region of the male retaining member. Alternately, a plurality of male retaining members may be included.

In the present relay having the armature and the male retaining member(s) extending from the yoke, the armature retaining spring is secured only in the region in front of the bearing edge and in front of the armature itself. It thus is possible to set the armature restoring force by bending the male retaining member(s). A rated bending location is preferably included by providing a reduced cross-section on the male retaining member(s). Neither the rated bending location nor the narrowing of the yoke cross-section by the formation of the male retaining members deteriorates the magnetic flux of the ferrous circuit, since the male retaining members lie outside of the bearing edge.

It is within the scope of the present invention to provide an armature retaining spring bent and shaped to adapt to different types of male retaining member or members as determined by other established conditions. For example, the armature retaining spring can include a central spring web and two outer fastening tabs when male retaining members are arranged at the lateral regions of the yoke. Alternately, the armature retaining spring can include a central recess between two lateral spring webs as well as a cross-stay for fastening to a center male retaining member.

The male retaining member(s) preferably extend(s) in the plane of the second yoke leg. However, the male retaining member(s) can also form an angle relative to the plane of the yoke leg such as, for example, being crimped in front of the armature or being bent upward from the yoke leg. In an extreme case, it is possible to form a completely planar armature retaining spring with a fastening portion thereof secured to one or more male retaining members disposed perpendicular to the plane of the yoke leg.

If, however, the male retaining member(s) lies in the plane of the yoke leg, then a first portion of the retaining spring can either be bent away from the armature into the plane of the yoke or it can be bent in an arc, first away from the armature surface and then toward the armature in the plane of the yoke surface. Thus, depending on the design of the retaining spring, the retaining spring can perform different functions such as, for instance, impact protection for the armature.

A significant advantage realized by fastening the armature retaining spring at the salient male retaining members of the yoke is that the surface of the second yoke leg remains free up to the bearing edge. In other words, moving parts such as the bearing spring do not extend into the region over the winding nor does the surface of the yoke include additional steps which are difficult to seal. It is thus possible in a device according to the present invention to provide a partition between the coil space and a switch space encompassing the movable parts, the contact elements, and enclosing the pocket-shaped contact chamber. The partition is provided by a rib within the protective cap that abuts against the second yoke leg in the region of the first coil flange and against the first coil flange at each opposing side.

The rib within the protective cap forms a capillary gap with the second yoke leg at the upper side of the relay and with the first coil flange at the opposing sides. The capillary gap accepts casting compound when the coil space is filled with casting compound, but as a result of the capillary effect, the casting compound does not flow into the switch space. An additional development of the present invention is that the pocket-shaped contact chamber of the first coil flange forms a capillary gap with the opposing side walls of the protective cap so that the switch space, including the contact chamber, is sealed on all sides when the coil space is cast out. As a result of the casting compound with which the relay is filled up to the edge of the protective cap at the terminal side of the relay, the passages for plugging the contact elements in the contact chamber are simulataneously sealed.

To increase the dielectric strength between the coil winding and the current carrying yoke, it is further provided that the second coil flange includes ribs at both sides to enclose the first yoke leg. Moreover, the dielectric strength of the relay is significantly increased by filling the coil space with casting compound, since the space between the coil winding and the second yoke leg disposed above the winding is filled in with the insulating casting material.

In a particular embodiment of the present relay, a cross-stay proceeding parallel to the bearing edge is applied to at least one retaining web and a first portion of the armature retaining spring is disposed against the cross-stay. The cross-stay supports the armature retaining spring essentially over its full width. Given the armature motion, the armature retaining spring is prevented from sagging so that no torsional stress thereof occurs. The armature retaining spring is, thus, exposed only to bending stress in the bend between the first and second spring portions, enabling it to withstand a greater of number of switch events without risk of breaking.

It is crucial that essentially the full width of the armature retaining spring rests on the cross-stay. As such, welds can be included on the retaining webs laterally of the cross-stay. Expediently, however, the armature retaining spring is directly welded to the cross-stay with one or two spot welds or is secured thereto by a comparable method.

In a preferred embodiment, the yoke includes retaining webs, or male retaining members, as extensions of the two side edges, the retaining webs being connected to one another by a cross-stay, so that together with the cross-stay and the oppositely disposed bearing edge, they frame the armature retaining spring and, in some embodiments, the armature as well. Fastening, in this case, is provided by the retaining spring being fastened to the armature and being bent outwardly with respect to the coil and threaded from below through the frame-like slot between the retaining webs and the cross-stay. The bent end of the armature retaining spring is then welded onto the cross-stay from above.

In another embodiment, one male retaining member is provided at only one side of the yoke and a cross-stay, together with the bearing edge, forms a slot open at one side. Assembly is, thus, simplified since the armature with the armature retaining spring is easily plugged into the slot from the open side and then secured.

Further modifications are also possible in a relay according to the principles of the present invention. Thus, for example, a centrally arranged retaining web may be provided, the cross-stay being T-shaped and extending toward both sides of the yoke from the end of the retaining web or male retaining member. The armature retaining spring and the armature would both be provided with a centrally disposed recess.

DETAILED DESCRIPTION OF THE PREFERRED EMBODIMENTS

Figure 1:
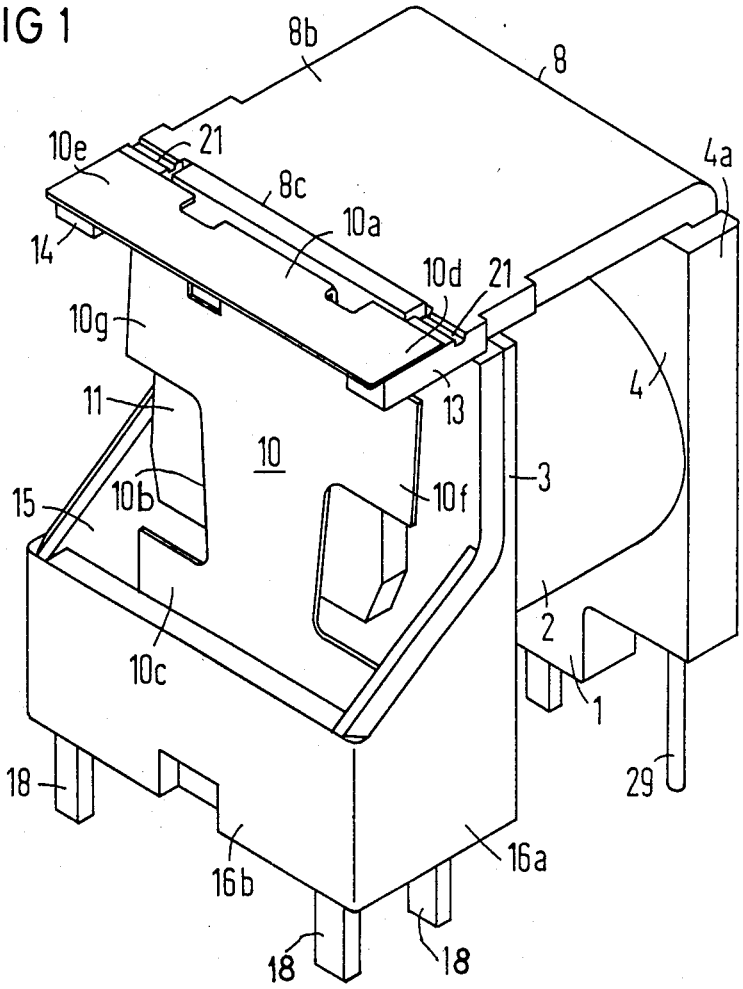
FIG. 1 is a perspective view of an electromagnetic relay embodying the principles of the present invention.
Figure 2:
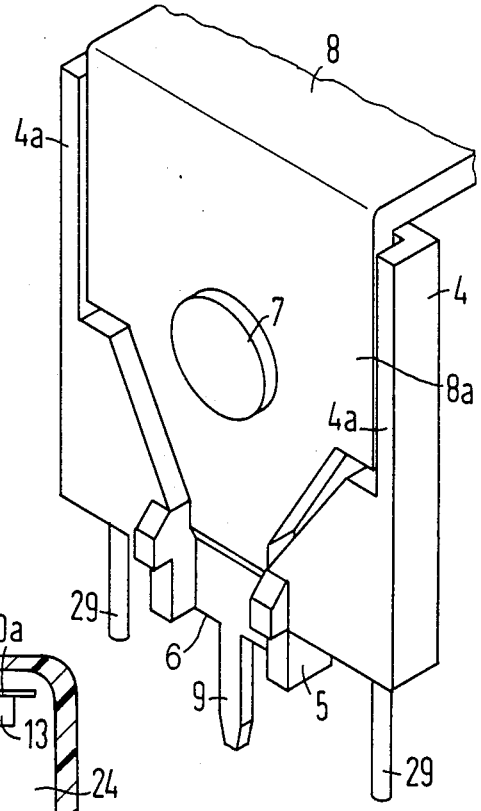
FIG. 2 is a fragmentary perspective view from the back of the relay of FIG. 1 showing a second coil flange and first yoke leg.
Figure 3:
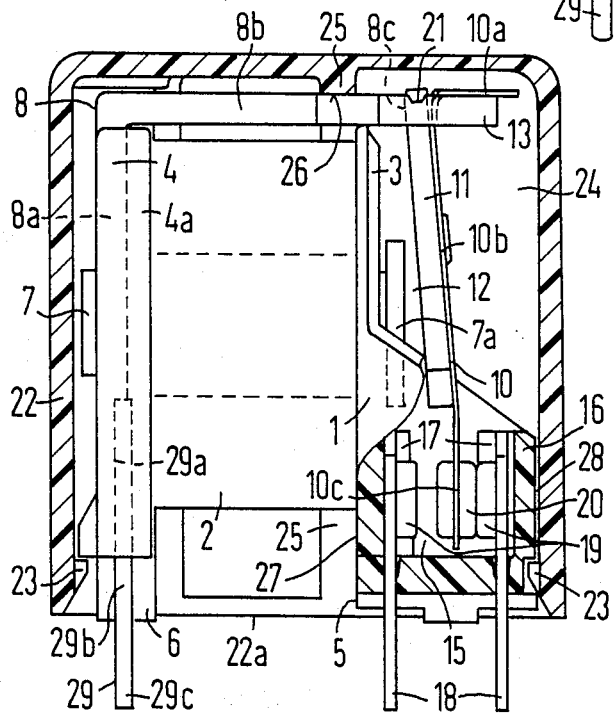
FIG. 3 is a vertical cross-section of the relay shown in FIG. 1 and including a protective cap.

An electromagnetic relay embodying the principles of the present invention is shown in FIG. 1, including additional details depicted in FIGS. 2 and 3. The relay includes a coil body 1 which serves as a carrier or base that carries a coil winding 2 and which includes first and second coil flanges 3 and 4 for limiting the winding space. At the underside of the coil flanges 3 and 4 as shown in FIGS. 2 and 3, shoulders 5 and 6 are provided which together define a mounting plane for the relay. The coil winding 2 has a winding axis extending parallel to the mounting plane of the relay and a core 7 disposed within the coil 2 coaxially of the winding axis. The core 7 has a broadened pole member 7*a* at one end in the region of the first coil flange 3 and is connected to an angled yoke 8 at an opposite end in the region of the second coil flange 4.

The angled yoke 8 includes a first leg 8*a* extending perpendicular to the mounting plane at the region of the second coil flange 4, the first leg 8*a* being framed at each side by rib-shaped set-offs 4*a* extending from the second flange 4. As shown more clearly in FIG. 2, the first yoke leg 8*a* merges into an applied terminal spine 9 extending in a downward direction, which, when connected to power, feeds power to a movable contact spring 10 through the yoke 8. A second yoke leg 8*b* extends parallel to the mounting plane of the relay above the coil 2. At its free end, a bearing edge 8*c* is formed for a flat armature 11.

The armature 11 forms a working air gap 12 with the core pole member 7*a*. The armature 11 is fastened by the contact spring 10, also referred to as an armature retaining spring, that is formed of leaf spring material. A first portion 10*a* of the spring 10 is secured to male retaining members, or retaining webs, 13 and 14 extending from the yoke leg 8*b*. A second leg 10*b* of the spring 10 rests on the armature 11 and is connected thereto. A third spring portion 10*c* forming a contact spring projects beyond the free end of the armature 11 into a contact chamber 15 that is formed by a pocket-shaped continuation 16 of the coil flange 3. The continuation 16 is provided with plug-in slots 17 disposed opposite one another in pairs for accepting cooperating contact elements 18. The cooperating contact elements 18 are each provided with contact pieces 19 in the standard way, the contact pieces 19 interacting with corresponding contact pieces 20 on the contact spring 10. Depending upon the wiring arrangement, the contact spring 10 can serve either as a center contact spring or as a contact bridge without its own connection, in which case the terminal spine 9 of the yoke 8 would not be required.

The first portion 10*a* of the armature retaining spring, or contact spring, 10 is bent outward in the region of the yoke surface away from the armature surface, being bent into the plane of the yoke surface. Thus, two lateral tabs 10*d* and 10*e* extending from the spring 10 rest on the male retaining members 13 and 14, respectively, and are secured thereto. The two male members 13 and 14 are extensions of the yoke leg 8*b* in the yoke leg plane. A notch 21 is formed in each of the male retaining members 13 and 14 to form a rated bend location between the yoke leg 8*b* and the two male retaining members 13 and 14.

In the illustrated embodiment, the armature 11 is narrower than the yoke leg 8*b* so that the male retaining members 13 and 14 extend past both sides of the armature 11. Of course, the armature may also be as wide as the yoke leg 8*b*, in which case it would be relieved, or have recesses, in the region of the male retaining members 13 and 14. In such case, the sides of the armature 11 disposed below the male retaining members 13 and 14 would serve as impact protection (see, for instance, FIG. 4). For the embodiment shown in FIG. 1, however, the armature retaining spring 10 is provided with stop tabs 10*f* and 10*g* at each side which strike against the male retaining members 13 and 14, respectively, in a vertical direction during impact motion of the armature 11.

The restoring force for the armature 11 can be set by bending the male retaining members 13 and 14. Since the two male retaining members 13 and 14 are disposed in front of the bearing edge 8*c* and in front of the armature 11, they are outside of the ferro-magnetic flux circuit and no loss of magnetic flux occurs from the shaping and bending of the male retaining members 13 and 14. The width of the yoke 8 is completely utilized in the magnetic circuit.

As seen in FIG. 3, the relay is provided with a protective cap 22 that surrounds all but the mounting side of the relay. The protective cap 22 is held to the coil member 1 with catch noses, or snap locks, 23 between the cap 22 and the body 2. When the protective cap 22 is in place, a switch space 24 which includes the contact chamber 15 contains all of the moving parts of the relay and is completely separated from the coil space by a rib 25.

The rib 25 at the inside of the cap 22 is disposed over the yoke leg 8*b* above the coil flange 3 and also extends along the side regions of the relay overlapping the coil flange 3 to form sealing regions. Since the male retaining members 13 and 14 with the armature retaining spring portion 10*a* secured thereto are at an end face at the front of a free end of the yoke 8, the rib 25 can form a planar capillary gap 26 with the yoke leg 8*b* approximately above the coil member flange 3. Additional capillary gaps 27 are formed between the rib 25 and the sides of the coil flange 3.

To seal the relay, the terminal side of the relay is directed upwardly and the coil space is filled with casting compound (not shown) which envelops the winding 2 and the yoke 8 and also penetrates into the capillary gaps 26 and 27 but does not run into the switch space 24 or the contact chamber 15. When the casting compound is filled up to a lower edge 22*a* of the protective cap 22, it runs over the continuation 16 in the region of the terminal side and seals the passages provided for the contact elements 18. At the same time, the sealing compound runs into capillary gaps 28 formed between the protective cap 22 and side walls 16*a* and 16*b* of the continuation 16. The casting resin distributes itself in these large-area capillary gaps but does not penetrate into the contact chamber 15 or the switch space 24. The switch space 24 is thereby provided with a liquid-tight seal both from the outside, as well as being sealed from the coil winding 2.

By casting out the coil winding 2 with casting compound, not only is heat dissipation improved but also an increased dielectric strength is achieved by the insulating effects of the casting compound between the coil winding 2 and the yoke 8. Another contributing factor to the increased dielectric strength is the provision of the coil terminal pins 29 having upper ends 29*a* embedded in the coil flange 4 and salient parts 29*b* projecting from the coil flange 4 to which ends of the winding 2 are wrapped and soldered which are insulated by the casting resin. Thus, only ends 29*c* of the terminal pins 29 are exposed.

In FIGS. 4 through 7 various modifications of armature fastenings are shown, wherein for the sake of simplicity, only the yoke leg 8*b* with an armature, a retaining spring, and male retaining members or webs are shown.

Figure 4:
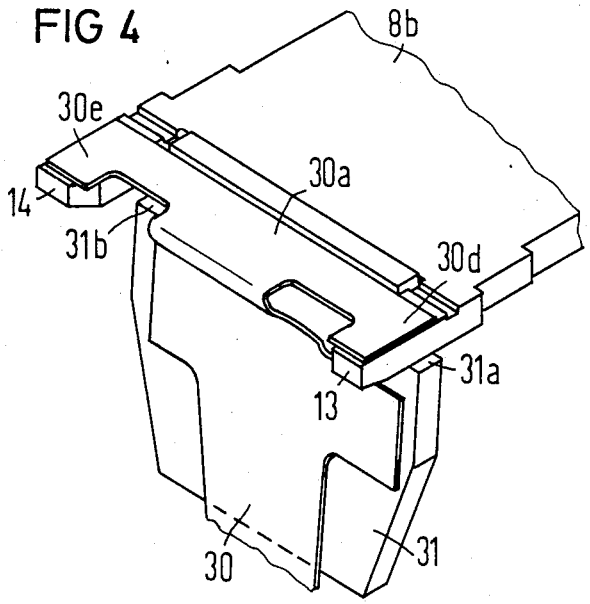
FIG. 4.is a fragmentary perspective view of another embodiment of an armature fastening according to the present invention.

In the embodiment of FIG. 4, the yoke leg 8*b* includes the male retaining members 13 and 14 as in the example of FIGS. 1–3. In contrast thereto, however, an armature retaining spring 30 is provided with an upper region 30*a* bent in an S-configuration away from an armature 31. The retaining spring 30 is bent toward the outside and then bent into the plane of the surface of the yoke leg 8*b*. It is then secured to the male retaining members 13 and 14 by laterally extending tabs 30*d* and 30*e*.

The armature 31 has shoulders 31*a* and 31*b* provided below the male retaining members 13 and 14, respectively, which strike against the male retaining members 13 and 14 when a compound of armature movement is in a vertical direction. The shoulders 31*a* and 31*b* thereby help secure the armature 31 in place. Notches are formed on the retaining members 13 and 14 for bonding to adjust the armature restoring force.

Figure 5:
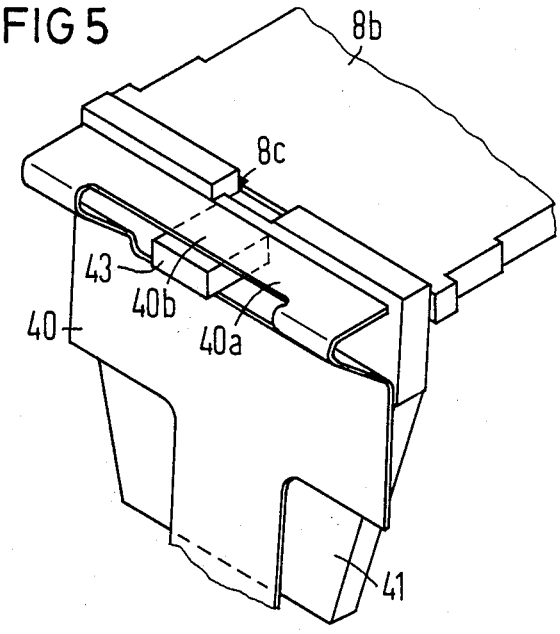
FIG. 5 is a fragmentary perspective view of a further embodiment of an armature fastening according to the present invention.

Referring now to FIG. 5, a further type of armature mounting is shown. A single centrally located male retaining member 43 extends from the yoke leg 8*b*. An armature retaining spring 40 is formed in an S-shaped bend at an upper region 40*a* with a first bend away from an armature 41 and then a second bend toward the armature 41 in the plane of the surface of the yoke leg 8*b*. A cross-stay 40*b* is provided on the armature retaining spring that lies over the male retaining member 43 and is secured thereto. The armature 41 abuts the bearing edge 8*c* of the yoke leg 8*b* on either side of the male retaining member 43 and, thus, includes a centrally disposed recess within which the central male retaining member 43 fits. The armature restoring force for a relay equipped with the armature mounting of FIG. 5 can be set by bending the male retaining member 43, such as at the notch extending laterally thereof.

Figure 6:
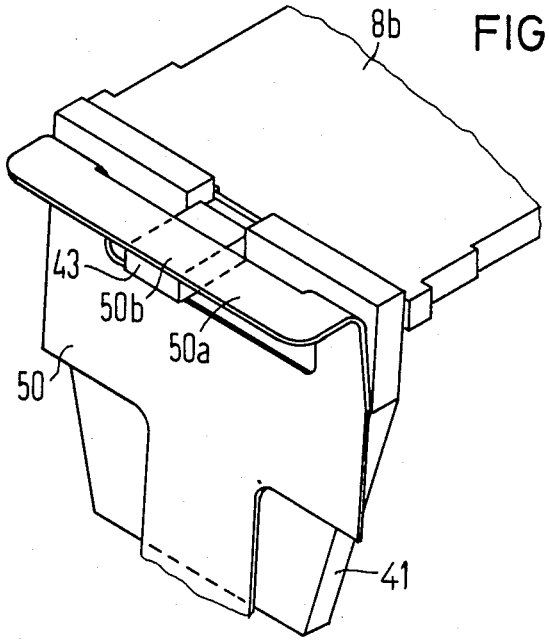
FIG. 6 is a fragmentary perspective view of another armature fastening according to the present invention.

In FIG. 6, the yoke leg 8*b* also includes a central male retaining member 43. However, an armature retaining spring 50 is provided in the embodiment of FIG. 6 that has an upper region 50*a* bent away from the armature 41 in the plane of the surface of the yoke leg 8*b*. A cross-stay 50*b* spanning an opening formed in the retaining spring 50 is disposed lying on the male retaining member 43. As in the example of FIG. 5, the armature restoring force can be adjusted by bending of the male retaining member 43.

Figure 7:
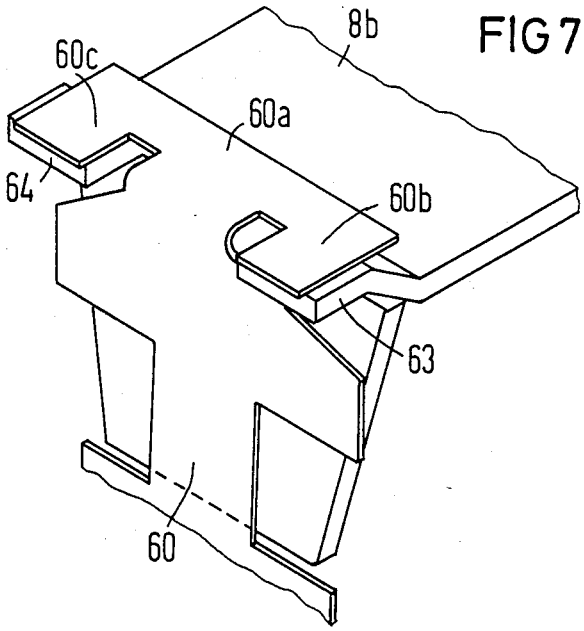
FIG. 7 is yet another embodiment of an armature fastening of the present invention.

As shown in FIG. 7, a further modification of the present invention includes two laterally located male retaining members 63 and 64 formed as continuations of the yoke leg 8*b*, yet which are crimped, or offset. An armature retaining spring 60 having first and second lateral tabs 60*b* and 60*c* at an upper portion 60*a* is mounted by placement of the tabs 60*b* and 60*c* over respective ones of the retaining members 63 and 64. As in the previous embodiments, adjustment of the armature restoring force is made by bending the male retaining members 63 and 64.

It is within the scope of the present invention to provide male retaining members which are bent or crimped in other various ways or which, for example, extend perpendicularly from the yoke leg 8*b*..

Figure 8:
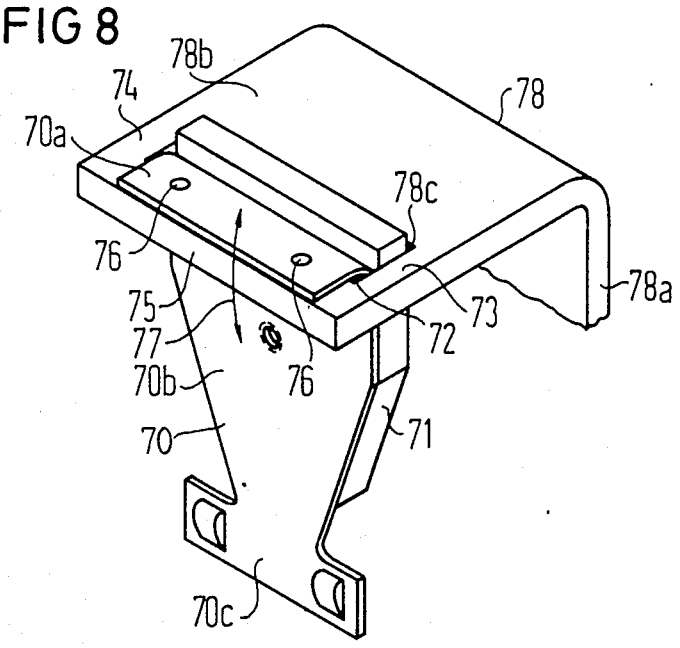
FIG. 8 is a partial perspective view of a modified armature fastening of the present invention.

A further embodiment of the present invention is shown in FIG. 8 and includes a yoke 78 having a first yoke leg 78*a* and a second leg 78*b* lying flat over a coil (not shown). A bearing edge 78*c* is formed on the yoke leg 78*b* and a flat armature 71 is seated and secured thereto by an armature retaining spring 70. The armature retaining spring 70 includes a first portion 70*a* for fastening to the yoke 78. A center portion 70*b* of the armature retaining spring 70 is connected to the armature 71 and a portion 70*c* functions as a contact spring and includes contact members. The yoke 78 has two lateral retaining webs 73 and 74 formed as extensions of the yoke side edges and connected at the ends by a cross-stay 75 for holding the armature 71 and the armature retaining spring 70. A slot 72 is, thus, formed between the bearing edge 78*c*, the retaining webs 73 and 74 and the cross-stay 75. The armature 71 and the armature retaining spring 70 extend upward into the slot 72 with a full width of the retaining spring 70 being disposed on the cross-stay 75. The armature retaining spring 70 is secured to the cross-stay 75 in the illustrated embodiment by two spot welds 76. Armature movement in the example of FIG. 8 results in only bending stress to the cross-stay 75.

Figure 9:
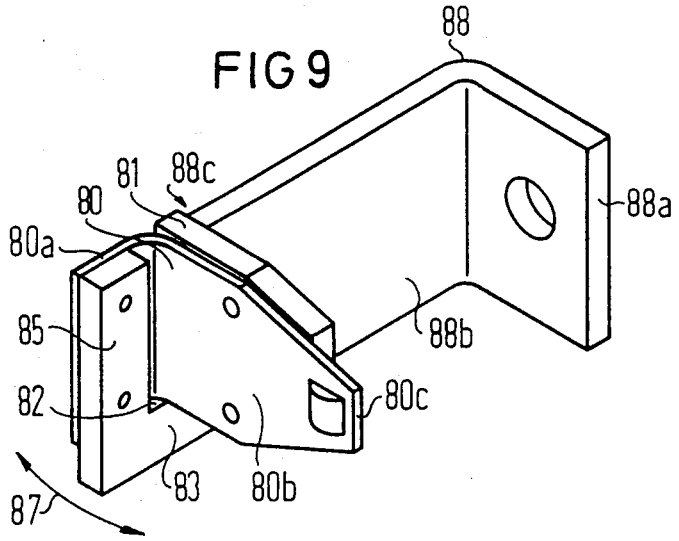
FIG. 9 is a perspective view of a yoke, armature and retaining spring of yet another embodiment of the present invention.

A further modification of the present invention is shown in FIG. 9 including a yoke 88 shown on its side. An armature mounting of the present invention can thus be used in a magnetic system disposed laterally within a housing as well. In FIG. 9, the yoke 88 has a first leg 88*a pl and a second leg 88b* having a bearing edge 88*c*— shown behind an armature 81. A retaining web 83 extends from one side of the yoke leg 88*b* and includes a cross-stay extending parallel to the bearing edge 88*c*. An armature retaining spring 80 having a first portion 80*a* welded to the cross-stay 85 is disposed within a slot 82 formed between the cross-stay 85 and the bearing edge 88*c*. A center portion 80*b* of the armature retaining spring 80 is connected to the armature 81 and an end portion 80*c* of the spring 80 is provided with a contact member and serves as a contact spring.

The slot 82 is open to the top, or may be oriented to open from the side, and provides an opening into which the armature 81 and the retaining spring 80 are inserted during assembly. In the horizontally disposed system shown in FIG. 9, the armature 81 and armature spring 80 are simply plugged in to the slot 82 from above.

In both the embodiments of FIGS. 8 and 9, an adjustment of the armature restoring force is possible simply by bending the retaining webs 73 and 74, or, respectively, 83. The bending causes a deflection in the cross-stays 75 or 85, respectively, in the direction of the double arrows 77 or 87.

Although modifications and changes may be suggested by those skilled in the art, it is the intention of the inventors to embody within the patent warranted hereon all changes and modifications as reasonably and properly come within the scope of their contribution to the art.

I claim as my invention:

1. An electromagnetic relay, comprising:

a coil forming a base body and having a winding around a core;

first and second flanges at respective opposite ends of said winding, said first flange having a portion forming a pocket-shaped contact chamber;

an angled yoke having a first leg at said second flange, said first leg being perpendicular to an axis of said coil and being coupled to said core, a terminal spine formed at a free edge of said first leg, a second leg of said angled yoke disposed parallel to the axis of said coil and above said winding and having a bearing edge at a free end, at least one male retaining member projecting beyond said bearing edge of said second yoke leg;

a plate-shaped armature seated at said bearing edge and forming a working air gap with the coil core and an end face of said coil at which said first flange is mounted;

an armature retaining spring having a first portion secured to said at least one male retaining member in the region of said end face in front of said bearing edge, a second portion of said armature retaining spring secured to said armature and a third portion extending into said contact chamber;

a protective cap over said coil and having a rib disposed against said second yoke leg in the region opposite said first flange and disposed against said first flange in overlapping fashion at lateral regions of said first flange.

2. An electromagnetic relay as claimed in claim 1, wherein said plate-shaped armature includes a recess in the region of said at least one male retaining member.

3. An electromagnetic relay as claimed in claim 1, wherein said at least one male retaining member is provided with a cross-sectional attenuation to form a rated bending location.

4. An electromagnetic relay as claimed in claim 1, wherein said at least one male retaining member is an extension of said second yoke leg and lies in the plane of said second yoke leg.

5. An electromagnetic relay as claimed in claim 1, wherein said protective cap forms a capillary gap with said portion of said first flange forming said pocket-shaped contact chamber.

6. An electromagnetic relay as claimed in claim 5, further comprising:

a casting compound filling said protective cap in the region of said coil and around said contact chamber so that capillary gaps between said protective cap and said coil and said second yoke leg are sealed.

7. An electromagnetic relay as claimed in claim 1, further comprising:

a cross-stay extending parallel to said bearing edge from a free end of said at least one male retaining member, and wherein said first portion of said armature retaining spring is disposed against cross-stay.

8. An electromagnetic relay as claimed in claim 7, wherein said armature retaining spring is welded to said cross-stay.

9. An electromagnetic relay as claimed in claim 7, wherein one of said male retaining members extends from said bearing edge at each side of said second yoke leg, and wherein said cross-stay connects ends of said male retaining members to form a frame-like opening, said armature retaining spring and said armature extending through said frame-like opening.

10. An electromagnetic relay as claimed in claim 7, wherein one of said male retaining member projects from said bearing edge at one side of said second yoke leg, and wherein said cross-stay extends from an end of said one male retaining member to form a slot open at one side between said cross-stay and said bearing edge.

11. An electromagnetic relay as claimed in claim 7, wherein said male retaining member extends centrally from said bearing edge of said second yoke leg, and wherein said cross-stay forms a T-shaped projection from a free end of said male retaining member.

* * * * *